US008807120B2

(12) United States Patent
Beer et al.

(10) Patent No.: US 8,807,120 B2
(45) Date of Patent: Aug. 19, 2014

(54) METHOD AND DEVICE OF OPERATING AN INTERNAL COMBUSTION ENGINE

(75) Inventors: Johannes Beer, Regensburg (DE); Milos Tichy, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 327 days.

(21) Appl. No.: 13/382,103

(22) PCT Filed: May 27, 2010

(86) PCT No.: PCT/EP2010/057354

§ 371 (c)(1),
(2), (4) Date: Jan. 3, 2012

(87) PCT Pub. No.: WO2011/000640

PCT Pub. Date: Jan. 6, 2011

(65) Prior Publication Data

US 2012/0097133 A1 Apr. 26, 2012

(30) Foreign Application Priority Data

Jul. 3, 2009 (DE) ..... 10 2009 033 080

(51) Int. Cl.
*F02M 51/00* (2006.01)
*F02M 51/06* (2006.01)

(52) U.S. Cl.
USPC ..... 123/490; 123/472

(58) Field of Classification Search
USPC ..... 123/490, 472, 476, 478, 499; 251/129.15
See application file for complete search history.

(56) References Cited

U.S. PATENT DOCUMENTS

| | | | | |
|---|---|---|---|---|
| 4,631,628 | A * | 12/1986 | Kissel | 361/154 |
| 4,676,478 | A * | 6/1987 | Kiuchi | 251/129.08 |
| 5,430,601 | A | 7/1995 | Burcham | 361/154 |
| 5,892,649 | A * | 4/1999 | Kahr et al. | 361/154 |
| 6,390,082 | B1 * | 5/2002 | Duffy et al. | 123/682 |
| 6,453,876 | B1 * | 9/2002 | Fukutomi et al. | 123/490 |
| 6,571,773 | B1 | 6/2003 | Yamakado et al. | 123/490 |
| 2004/0223282 | A1 * | 11/2004 | Bolz et al. | 361/139 |
| 2005/0066940 | A1 * | 3/2005 | Sheikh et al. | 123/446 |
| 2009/0078799 | A1 | 3/2009 | Achleitner et al. | 239/585.5 |

FOREIGN PATENT DOCUMENTS

| | | | | |
|---|---|---|---|---|
| DE | 3733091 | A1 | 4/1989 | F02D 41/20 |
| DE | 10147484 | A1 | 4/2003 | F02D 41/14 |
| DE | 102007045513 | A1 | 4/2009 | F02D 41/20 |
| EP | 622536 | A2 | 11/1994 | F02D 41/20 |
| EP | 1072779 | A2 | 1/2001 | F02D 41/20 |
| KR | 100756188 | B1 | 9/2007 | F02D 41/20 |

OTHER PUBLICATIONS

International PCT Search Report and Written Opinion, PCT/EP2010/057354, 17 pages, Sep. 2, 2010.

* cited by examiner

*Primary Examiner* — Mahmoud Gimie
(74) *Attorney, Agent, or Firm* — King & Spalding L.L.P.

(57) ABSTRACT

An internal combustion engine has at least one injection valve for delivering fluid, which has an electromagnetic actuator. A final stage unit is designed for creating a current profile for triggering the electromagnetic actuator with at least one given profile parameter (PP). Upon achieving magnetic saturation of a magnetic circuit of the electromagnetic actuator an assigned saturation current (I_sat_mes) is determined and at least one profile parameter (PP) is adjusted depending on the saturation current (I_sat_mes) thus determined and a given reference saturation current.

20 Claims, 5 Drawing Sheets

METHOD AND DEVICE OF OPERATING AN INTERNAL COMBUSTION ENGINE

CROSS-REFERENCE TO RELATED APPLICATIONS

This application is a U.S. National Stage Application of International Application No. PCT/EP2010/057354 filed May 27, 2010, which designates the United States of America, and claims priority to German Application No. 10 2009 033 080.1 filed Jul. 3, 2009, the contents of which are hereby incorporated by reference in their entirety.

TECHNICAL FIELD

The invention relates to a method and to a device for operating an internal combustion engine comprising at least one injection valve for metering fluid, which injection valve comprises an electromagnetic actuator. In addition, an output stage unit is designed to generate a current profile for actuating the electromagnetic actuator with at least one profile parameter.

BACKGROUND

Increasingly strict legal requirements for the permissible emissions of pollutants by motor vehicles, which are arranged in the internal combustion engines, make it necessary to keep emissions of pollutants as low as possible during the operation of the internal combustion engine. This can be done, on the one hand, by reducing emissions of pollutants which arise during the combustion of the air/fuel mixture in the respective combustion chamber of the cylinder of the internal combustion engine. On the other hand, exhaust gas post-treatment systems are used in internal combustion engines, said exhaust gas post-treatment systems converting the emissions of pollutants which are generated during the combustion process of the air/fuel mixture in the respective combustion chambers of the cylinders into harmless substances.

Internal combustion engines can be operated in various operating modes. For example, a homogeneous air/fuel mixture can therefore be generated with a air/fuel ratio which is approximately stoichiometric. Furthermore, the internal combustion engine can also be operated with a stratified charge of the air/fuel mixture in which a very lean mixture can be burnt in the combustion chamber by virtue of the fact that a stratified charge takes place in the vicinity of an ignition actuator.

In addition, the metering of fuel during a working cycle can also be divided into a plurality of partial injections in relation to a respective cylinder. Values of operating variables generally determine which of the operating modes the internal combustion engine is operated in. A suitable strategy during the selection of the operating modes makes it possible, on the one hand, to reduce emissions of pollutants, but on the other hand also allows possibly desired efficient operation of the internal combustion engine to be ensured.

Particularly great significance is accorded in this context to precise metering of the respective quantity of fuel which is to be metered by the respective injection valve. A particular demand in this context is a very high quantity spread of the required quantity of fuel which is to be metered by the respective injection valve.

For example, in the operating mode which is close to idling it is therefore possible to meter an extremely small quantity of fuel, while at full load of the engine it is possible to meter a very high quantity of fuel.

SUMMARY

According to various embodiments, a method and a device for operating an internal combustion engine can be provided which permit reliable and precise operation of the internal combustion engine.

According to an embodiment, in a method for operating an internal combustion engine comprising at least one injection valve for metering fluid, which injection valve comprises an electromagnetic actuator, having an output stage unit which is designed to generate a current profile for actuating the electromagnetic actuator with at least one predefined profile parameter,—a saturation current which is assigned, when the magnetic saturation of the magnetic circuit of the electromagnetic actuator is reached, is determined, and—at least one profile parameter is adapted as a function of the determined saturation current and a predefined reference saturation current.

According to a further embodiment, the current profile may comprise a rapid rise phase during which a driver voltage which is increased compared to a supply voltage of the output stage unit is applied to the electromagnetic actuator, wherein during various actuations setpoint peak values of the current in the electromagnetic actuator are varied and respective time periods up to the point when the respective setpoint peak value is reached during the rapid rise phase are determined and the respective time periods which are determined in this way are stored with the respective setpoint peak values as value tuples, and the saturation current is determined as a function of the determined value tuples. According to a further embodiment, a first approximation straight line may be determined as a function of those value tuples whose setpoint peak values are below a first predefined threshold value, and a second approximation straight line is determined as a function of those value tuples whose setpoint peak values are above a predefined second threshold value which is larger than the first threshold value, and wherein the saturation current is determined as a function of a point of intersection of the first approximation straight line with the second approximation straight line. According to a further embodiment, the approximation straight lines can be determined by means of a regression method as a function of the least square error method. According to a further embodiment, the variation of the setpoint peak values of the current for determining the value tuples can be carried out when predefined activation conditions apply. According to a further embodiment, the current profile may comprise a rapid rise phase during which a driver voltage which is increased compared to a supply voltage of the output stage unit is applied to the electromagnetic actuator, wherein during the rapid rise phase actual current values of the current are determined in the electromagnetic actuator at various predefined times and the respective actual current values which are determined in this way are stored with the assigned times as value tuples and the saturation current is determined as a function of the determined value tuples. According to a further embodiment, a first approximation straight line can be determined as a function of those value tuples whose actual current value is below a first predefined threshold value, and a second approximation straight line can be determined as a function of those value tuples whose actual current value is above a predefined second threshold value which is larger than the first threshold value, and wherein the saturation current is determined as a function of a point of intersection of the first approximation straight line with the second approximation straight line. According to a further embodiment, the approximation straight lines can be determined by means of a regression method as a function of the least square error method.

According to a further embodiment, the determination of the actual current values for determining the value tuples can be carried out when predefined activation conditions apply. According to a further embodiment, the predefined activation conditions may comprise a homogeneous operating mode of the internal combustion engine with a quasi-stoichiometric air/fuel ratio. According to a further embodiment, the predefined activation conditions may comprise an idling mode or partial load operating mode of the internal combustion engine with quasi-steady-state operation. According to a further embodiment, the predefined activation conditions may comprise the fact that a cooling water temperature and/or engine oil temperature and/or output stage unit temperature are in respectively predefined temperature intervals. According to a further embodiment, the predefined activation conditions may comprise the fact that a fluid pressure which is applied to the injection valve on the input side is set to a predefined low pressure value.

According to another embodiment, a device for operating an internal combustion engine comprising at least one injection valve for metering fluid, which injection valve comprises an electromagnetic actuator, having an output stage unit which is designed to generate a current profile for actuating the electromagnetic actuator with at least one predefined profile parameter, may be designed—to determine an assigned saturation current when the magnetic saturation of a magnetic circuit of the electromagnetic actuator is reached, and—to adapt at least one profile parameter as a function of the determined saturation current and a predefined reference saturation current.

BRIEF DESCRIPTION OF THE DRAWINGS

Exemplary embodiments are explained in more detail below with reference to the schematic drawings, in which.

Elements with the same design or function are characterized by the same reference numbers throughout the figures.

DETAILED DESCRIPTION

Figure 1:
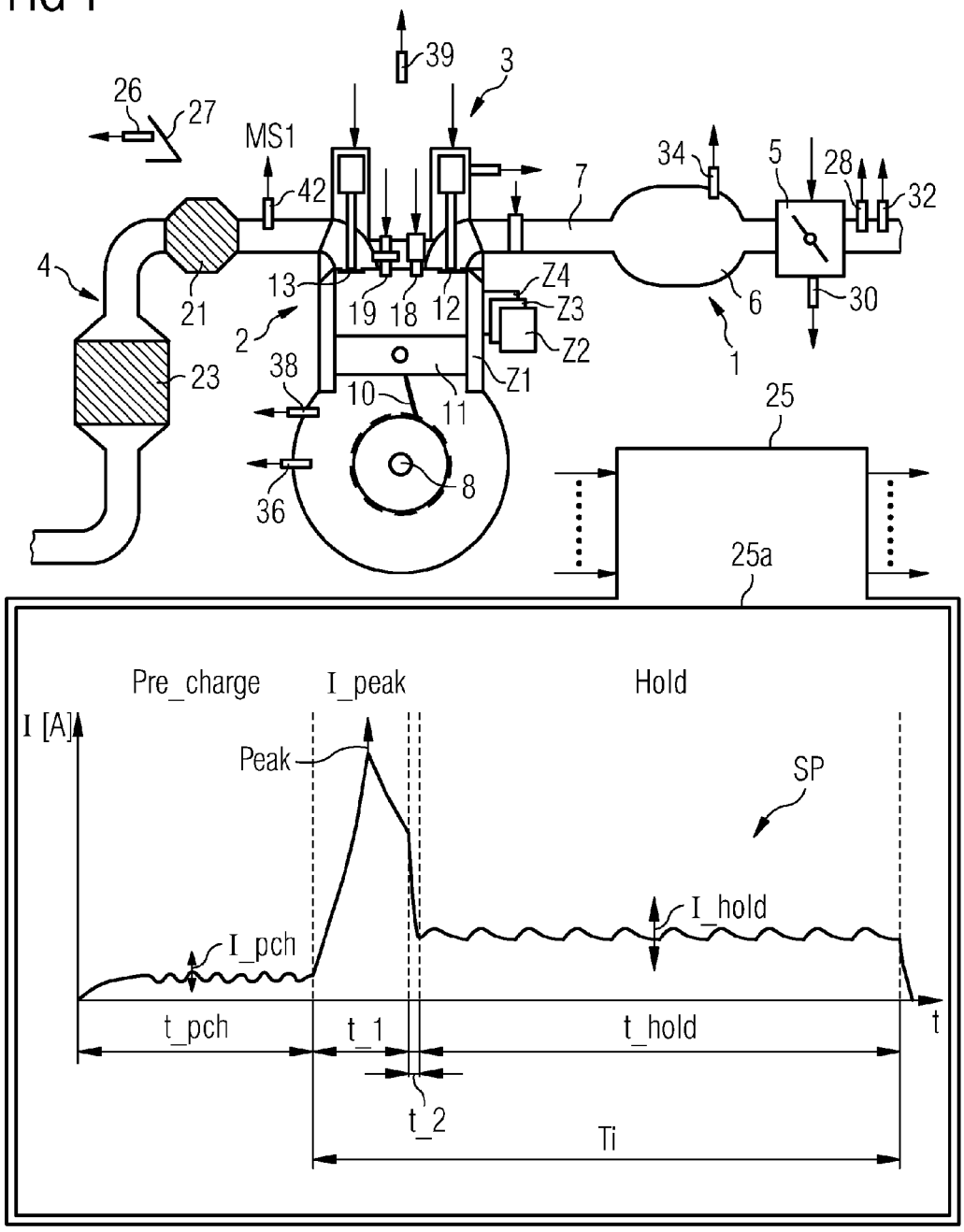
FIG. 1 shows an internal combustion engine with a control device.

According to various embodiments, in a method and a corresponding device for operating an internal combustion engine comprising at least one injection valve for metering fluid, which injection valve comprises an electromagnetic actuator, having an output stage unit which is designed to generate a current profile for actuating the electromagnetic actuator with at least one predefined profile parameter, when the magnetic saturation of a magnetic circuit of the electromagnetic actuator is reached, an assigned saturation current is determined. The saturation current is therefore that electric current which flows in the magnetic circuit of the electromagnetic actuator when the saturation of said magnetic circuit is just brought about. At least one profile parameter is adapted as a function of the determined saturation current and a predefined reference saturation current. The predefined reference saturation current can be particularly easily determined in advance and permanently stored, for example, in a memory.

When the internal combustion engine is operating, the requirements which are made of the injection valves, metering the fuel, in terms of the quantity spread may be very stringent. For example there may be a factor of 15 between a minimum and a maximum quantity of fuel. Stringent requirements may also arise from a minimum quantity of fuel to be metered. In this context, in particular the fabrication tolerances of the injection valves and of the output stage unit pose challenges.

Determining the saturation current and adapting at least one of the profile parameters as a function of the determined saturation current and a reference saturation current makes it possible in a particularly easy fashion, in particular without appreciable additional expenditure on hardware, to compensate a cross influence of an accuracy level, restricted for the respective individual injector, of the current profile on the injection quantity, and therefore in particular to significantly improve the quantity accuracy in the region of very small quantities of fuel to be metered. In this context, the adaptation of at least one of the profile parameters as a function of the determined saturation current and the predefined reference saturation current makes it possible in a suitable, predefined fashion, to perform such precise metering, in particular even of very small quantities of fuel.

According to an embodiment, the current profile comprises a rapid rise phase during which a driver voltage which is increased compared to a supply voltage of the output stage unit is applied to the electromagnetic actuator, wherein during various actuations setpoint peak currents of the current in the electromagnetic actuator are varied and respective time periods up to the point when the respective setpoint peak value is reached during the rapid rise phase are determined and the respective time periods which are determined in this way are stored with the respective setpoint peak values as value tuples, and the saturation current is determined as a function of the determined value tuples.

This permits particularly simple and precise determination of the saturation current, in particular in the case of an output stage unit in which the setpoint peak values can be changed while the internal combustion engine is operating.

According to a further embodiment, a first approximation straight line is determined as a function of those value tuples whose setpoint peak values are below a first predefined threshold value, and a second approximation straight line is determined as a function of those value tuples whose setpoint peak values are above a predefined second threshold value which is larger than the first threshold value. The saturation current is then determined as a function of a point of intersection of the first and second approximation straight lines. In this way, use can be made of the realization that owing to the magnetic saturation the inductivity of the magnetic circuit is reduced, resulting in a situation in which the gradient of the rise in current increases during the rapid rise phase. It is therefore possible to use the procedure involving the two approximation straight lines to implement a procedure for efficiently determining the saturation current which can be carried out particularly easily in terms of computing technology.

In this context it is particularly advantageous if the approximation straight lines are determined by means of a regression method as a function of the least square error method.

According to a further embodiment, the variation of the setpoint peak values of the current for determining the value tuples takes place when predefined activation conditions apply. In this way, an accuracy level during the determination of the saturation current can be increased.

The predefined activation conditions can advantageously comprise a homogeneous operating mode of the internal combustion engine with quasi-stoichiometric air/fuel ratios.

In addition, the predefined activation conditions can advantageously comprise an idling mode or partial load operating mode of the internal combustion engine with quasi-steady-state operation. The predefined activation conditions can advantageously also comprise the fact that a cooling water temperature and/or oil temperature and/or output stage unit temperature are in respectively predefined suitable temperature intervals. Such temperature intervals can be determined particularly easily, in particular in an application phase, for example empirically or else by means of simulations.

It is also particularly advantageous if the predefined activation conditions comprise the fact that a fluid pressure which is applied to the injection valve on the input side is set to a predefined low pressure value.

According to a further embodiment, the current profile comprises the rapid rise phase during which a driver voltage which is increased compared to the supply voltage of the output stage unit is applied to the electronic actuator. During the rapid rise phase, actual current values of the current in the electromagnetic actuator are determined at various predefined times, and the respective actual current values which are determined in this way are stored with the assigned times as value tuples. The saturation current is then determined as a function of the determined value tuples. This also permits precise determination of the saturation current, in particular in the case of an output stage unit which does not permit the setpoint peak values of the current to be adapted while the internal combustion engine is operating.

According to a further refinement, a first approximation straight line is determined as a function of those value tuples whose actual current values are below a first predefined threshold value, and a second approximation straight line is determined as a function of those value tuples whose actual current values are above a predefined second threshold value which is larger than the first threshold value. The saturation current is then determined as a function of a point of intersection of the first approximation straight line with the second approximation straight line. The advantages accordingly correspond in this respect to those when the first and second approximation straight lines are determined as a function of value tuples with the different setpoint peak values.

An internal combustion engine (FIG. 1) comprises an intake section 1, an engine block 2, a cylinder head 3 and an exhaust gas section 4. The intake section preferably comprises a throttle valve 5, a collector 6 and an intake manifold 7, which leads to a cylinder Z1 via an inlet duct of the engine block 2. The engine block 2 also comprises a crankshaft 8 which is coupled to the piston 11 of the cylinder Z1 via a connecting rod 10.

The cylinder head 3 comprises a valve drive with a gas inlet valve 12 and a gas outlet valve 13. The cylinder head 3 also comprises an injection valve 18 and an ignition actuator 19. The injection valve 18 preferably comprises an electromagnetic actuator, which comprises, in particular, a coil.

A catalytic converter 21, which is preferably embodied as a three-way catalytic converter, is arranged in the exhaust gas section 4. In addition, a further catalytic converter 23, which is embodied as a NOX catalytic converter, is preferably arranged in the exhaust gas section.

A control device 25 is provided to which sensors, which sense various measurement variables and each determine the value of the measurement variable, are assigned. Operating variables comprise both measurement variables and variables derived therefrom. The control device is designed to determine actuation variables as a function of at least one of the operating variables, which actuation variables are then converted into one or more actuation signals for controlling actuation elements which are assigned to the control device. The control device 25 is additionally assigned an output stage unit 25*a* which is designed to generate actuation signals for the respective injection valve 18 and which is explained in more detail below. The control device 25 can also comprise the output stage unit 25*a*.

The control device 25 can also be referred to as a device for operating the internal combustion engine. The control device comprises a memory which is designed to store data and program instructions, and a computing unit which is designed to carry out program instructions. The memory and the computing unit preferably form at least part of a computer which is included in the control device 25.

Sensors are a pedal position signal generator 26, which senses a position of an accelerator pedal 27, an air mass sensor 28 which senses an air mass flow rate upstream of the throttle valve 5, a first temperature sensor 32 which senses an intake air temperature, an intake manifold pressure sensor 34 which senses an intake manifold pressure in the collector 6, and a crankshaft angle sensor 36 which senses a crankshaft angle and to which a rotational speed is then assigned. In addition, a second temperature sensor 38 is provided which senses an operating temperature, for example a coolant, in particular a cooling water temperature and/or an oil temperature and/or an output stage unit temperature. Of course, a plurality of such second temperature sensors 38 can also be provided for separately sensing the specified temperatures. Furthermore, a pressure sensor 39 is provided which senses a fuel pressure, in particular in a high-pressure accumulator fuel supply.

An exhaust gas probe 42 is provided which is arranged upstream or in the catalytic converter 21 and which senses a residual oxygen content of the exhaust gas and whose measurement signal is characteristic of the air/fuel ratio in the combustion chamber of the cylinder Z1 and upstream of the first exhaust gas probe 42 before the oxidation of the fuel, referred to below as the air/fuel ratio in the cylinder Z1 to Z4.

Depending on the embodiment, any desired subset of the specified sensors may be present or additional sensors may be present.

The actuation elements are, for example, the throttle valve 5, the gas inlet and gas outlet valves 12, 13, the injection valve 18 or the ignition actuator 19.

In addition to the cylinder Z1, further cylinders Z2 to Z4 are generally also provided, said cylinders Z2 to Z4 then also being assigned corresponding actuation elements and, if appropriate, sensors. The internal combustion engine can therefore have any desired number of cylinders Z1 to Z4.

The output stage unit 25*a* is designed to generate a current profile SP for actuating the electromagnetic actuator of the injection valve 18, wherein the output stage unit can also be assigned a plurality of injection valves 18, with a single output stage. The output stage unit preferably comprises a current-regulated full-bridge output stage.

The characteristic curve of the injection valve 18 defines the relationship between the quantity of fuel which is to be metered and an injection time period Ti, which is, in particular, an electrical actuation period. The inversion of this relationship is used in the control device 25 in order to convert a setpoint fuel mass, which is to be metered, into a corresponding necessary injection time period Ti. Influencing variables, such as the fuel pressure, the internal pressure of the cylinders during the injection process, and possible variations of the supply voltage, play a role here.

Operation of the injection valve 18 in its linear working range limits the operating range, in particular at small injection quantities, by means of a quantity of fuel which is minimal with respect to the linear working range. The gradient of the characteristic curve of the injection valve 18 in the linear working range corresponds to the static flow through the injection valve 18, that is to say in particular to that fuel through-flow rate which is reached on a continuous basis at the complete valve stroke. This rate is defined by the effective flow cross-section at the complete valve stroke and when there is a pressure difference between the fuel pressure on the input side of the injection valve 18 and the internal pressure of the cylinder. Injection quantities which are smaller than the above-mentioned minimal quantity of fuel are found to have a highly non-linear behavior in the linear working range. The cause of this behavior is, in particular, the inertia of the spring mass system of the injection valve 18 and the chronological behavior when the magnetic field is built up and reduced in the electromagnetic actuator, said magnetic field being converted into corresponding forces for moving the valve needle of the injection valve. As a result of these dynamic effects, the complete injection valve stroke is no longer achieved in the ballistic range, that is to say the injection valve 18 is closed again before the structurally predefined end position, which is predefined by the maximum valve stroke of the valve needle, has been reached. In an operation in the non-linear range it is possible that owing to additional faults in the current profile SP and injection valve tolerances, for example a prestressing force of the closing spring, stroke of the valve needle, internal friction in the armature and/or needle system, significant errors may occur in the injection quantity which is actually metered unless further measures are taken.

In this context, the current profile SP is basically provided as what is referred to as a nominal current profile, to be precise, in particular, with respect to a predefined reference injection valve which is, however, basically not identical to what is then the actual injection valve 18.

It has become apparent that in the linear operating range, a fault in the current profile only has a relatively small effect on the quantity accuracy. The smaller the quantity of fuel to be metered by comparison, and to be precise, in particular, the smaller the quantity of fuel to be metered is than the smallest quantity of fuel which is to be metered in the linear working range, the more the quantity error rises to a significant level. In particular for injection times in the ballistic range there is a very strong cross influence on the quantity accuracy. However, it has become apparent that by adapting the current profile, that is to say for example also by adapting the error, the operating range of the respective injection valve 18 can be extended, by means of improved accuracy at the level of very small quantities, as far as injection quantities which are smaller than the quantity of fuel which is the minimal one in the linear working range.

The output stage unit 25 preferably comprises a current-regulated full-bridge output stage which is designed to operate the injection valve in a rapid rise phase with an increased driver voltage, referred to as boost voltage, of, for example, approximately 60 V. The increased driver voltage is preferably made available by a DC/DC converter.

The current profile SP, which is illustrated in an embodiment in the output stage unit 25*a* in FIG. 1, has actuation of the injection valve in various phases. At the start of the actuation, a pre-charge phase pre-charge occurs, specifically for a time period t_pch, which is referred to as a pre-charging time period. During this time period, the current for the electromagnetic actuator is set, in particular regulated, to a pre-charge current I_pch. This is preferably done by means of a two-point regulator.

The pre-charge phase pre-charge is followed by a rapid charge phase peak, which is also referred to as a boost phase. In this phase, the output stage unit applies the increased driver voltage at the coil of the electromagnetic actuator, specifically until a setpoint peak value I_peak_sp of the current is also actually reached as an actual peak value I_peak. The rapid current build up causes magnetic force to be made available which brings about movement of the needle of the injection valve 18 out of its closed position, and therefore initiates metering of fuel.

The output stage unit 25*a* is designed to generate a freewheeling phase if the actual peak value I_peak has reached the setpoint peak value I_peak_sp of the current. For example, the supply voltage can in turn be applied to the input side of the output stage unit 25*a* during the freewheeling phase.

A time period t_1 is provided or alternately predefined for the rapid rise phase peak and the freewheeling phase. The level of the setpoint peak value I_peak_sp and therefore the basic duration of the rapid rise phase peak has a high degree of correlation with the fuel pressure.

The output stage unit 25*a* is designed to control, after the expiry of the time period t_1, a commutation phase in which the magnetic field of the electromagnetic actuator of the injection valve 18 is reduced by the self-induction voltage which exceeds the increased driver voltage. The commutation phase is controlled in the timed fashion, to be precise for a time period t_2 which is, in particular, dependent on the time period t_1 and the supply voltage.

The output stage unit is also designed to control a holding phase hold which follows the commutation phase and in which a hold current I_hold is set, and is therefore preferably adjusted, to be precise, in particular, by means of a two-point controller, and to be precise driven by the supply voltage.

In this context, the output stage unit 25 is designed to set the hold phase for a hold time period t_hold.

Subsequent to the hold phase, there is a switch-off phase in which the magnetic field of the electromagnetic actuator of the injection valve 18 is then reduced by the self-induction voltage which exceeds the increased driver voltage, and the valve needle is then moved back into its closed position again as a function of the force balance which is then determined decisively by the spring force and the fuel pressure.

The profile parameter PP of the current profile SP are therefore, for example, the pre-charge time period t_pch and/or the time period t_1 and/or the time period t_2 and/or the hold time period t_hold and/or the pre-charging current I_pch and/or the setpoint peak value I_peak_sp of the current and/or the hold current I_hold. The injection time period Ti also basically constitutes one of the profile parameters PP.

Figure 4:
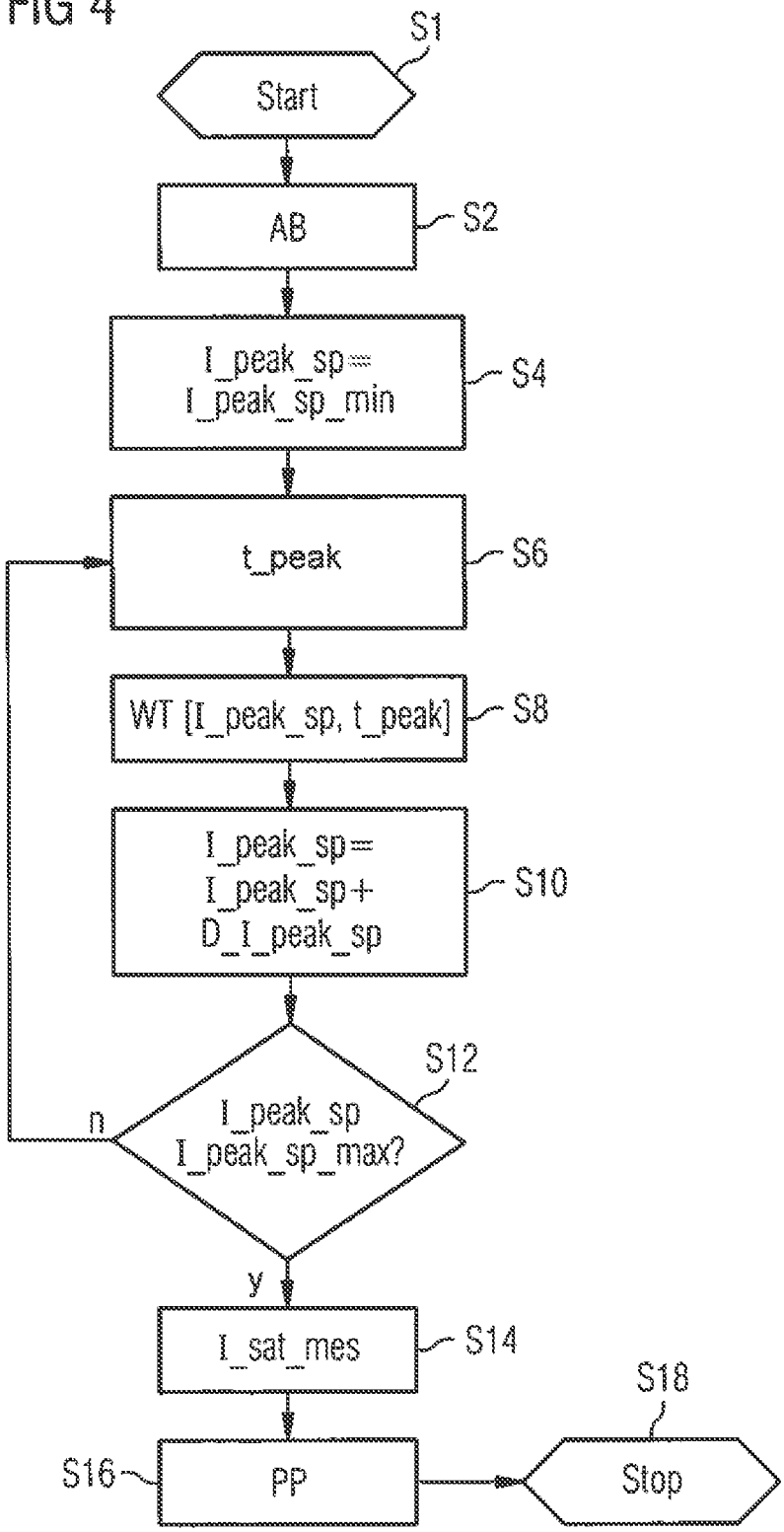
FIG. 4 shows a first flowchart.

A flowchart of a program for operating the internal combustion engine, which program is stored in the memory of the control device, and is run in the control device 25 during operation, is disclosed by means of FIG. 4. The program is started in a step S1 in which program parameters are preferably initialized. The start in the step S1 can take place, for example, close in time to an engine start or even later.

The program lingers in a step S2 until predefined activation conditions AB are met. The predefined activation conditions AB can comprise, for example, the fact that the internal combustion engine is operated in an approximately steady-state fashion in the homogeneous operating mode with a stoichiometric air/fuel ratio in the idling mode or partial load range. The predefined activation conditions AB can alternatively or additionally also comprise the fact that a single injection is controlled and/or no negative energization of the electromagnetic actuator of the injection valve 18 takes place to accelerate the closing of the valve needle. The activation conditions AB can also additionally or alternatively comprise the fact that the cooling water temperature and/or engine oil temperature and/or temperature of the output stage unit 25*a* are respectively in predefined temperature intervals. Furthermore, the activation conditions AB can alternatively or additionally comprise the fact that the fuel pressure is set to a predefined low pressure value which can be, for example, in the region of approximately 40 bar.

Furthermore, the activation conditions AB can alternatively or additionally comprise the fact that the pre-charge phase is dispensed with in the current profile SP. Furthermore, the activation conditions can comprise the fact that the time period t_1 is predefined in such a way that a maximum value I_peak_sp_max can be reached within the time interval which is defined in such a way, wherein the maximum value I_peak_sp_max is a current value at which the magnetic saturation of the magnetic circuit of the electromagnetic actuator has certainly occurred.

Subsequent to the step S2, a step S4 is processed in which the setpoint peak value I_peak_sp of the current is set to a minimal setpoint peak value I_peak_sp_min which is predefined. The minimal setpoint peak value I_peak_sp_min is to be preferably predefined in such a way that reliable opening of the valve needle for the predefined activation conditions AB is brought about taking into account the tolerances, in particular in the region of the injection valve 18, the current profile SP and/or the fuel pressure. In this context, allowance is preferably made for the fact that the dynamics of the opening of the valve needle are not influenced, or are only influenced to a negligible degree, by variation in the setpoint peak value I_peak_sp toward relatively large values. As a result, the model which is predefined for the current profile SP, can be used to calculate the injection time period Ti and therefore, in particular, the injection time period Ti can be determined as a function of the quantity of fuel which is to be metered, the fuel pressure and a starting time of the injection.

The rapid charge phase peak takes place until the actual peak value I_peak is equal to the setpoint peak value I_peak_sp of the current, and the assigned time period t_peak is preferably determined by means of a corresponding timer. The time period t_2 of the commutation phase is, in particular, dependent on the supply voltage, the time period t_1 and also the actual peak value I_peak. The hold phase hold is dimensioned in such a way that the hold time period t_hold and the time period t_1, t_2 give rise to the injection time period Ti.

The step S6 is preferably run through repeatedly with the same parameters, so that a mean value of the time period t_peak can be determined by the time that the setpoint peak value I_peak_sp of the current is actually reached.

In a step S8, depending on the refinement, value tuples of the respective setpoint peak value I_peak_sp and of the time period t_peak, which is, if appropriate, averaged, are then, in particular, buffered in the memory of the control device until the setpoint peak value I_peak_sp of the current is actually reached.

In a step S10, the setpoint peak value I_peak_sp of the current is increased by an increase value D_I_peak_sp, which is, in particular, suitably predefined in such a way that the maximum value I_peak_sp_max at which the saturation of the magnetic circuit is already reliably reached is achieved only through a given number of such increases.

In a step S12 it is checked whether the setpoint peak value I_peak_sp of the current is larger than the maximum value I_peak_sp_max. If this is not the case, the processing is continued again in the step S6.

On the other hand, if the condition of the step S12 is met, the suitable number of value tuples WT has then been determined and buffered, and the processing is continued in a step S14. In the step S14, a saturation current I_sat_mes which is assigned to the point when the magnetic saturation of the magnetic circuit of the electromagnetic actuator of the injection valve 18 is reached is determined. This is preferably done by determining a first and second approximation straight line AG1, AG2 and subsequently determining a point of intersection between the first and second approximation straight lines AG1, AG2. The first approximation straight line AG1 is determined as a function of those value tuples WT whose setpoint peak values I_peak_sp are below a first predefined threshold value. The second approximation straight line AG2 is determined as a function of those value tuples WT whose setpoint peak values I_peak_sp are above a predefined second threshold value which is larger than the first threshold value. The first and second threshold values are suitably predefined in such a way that the saturation current I_sat_mes, in particular its reference value, is reliably between the first and second threshold values. The approximation straight lines AG1, AG2 are preferably determined by means of a regression method as a function of the least square error method by means of the respectively assigned value tuples WT.

An exemplary profile of the approximation straight lines AG1, AG2 is illustrated in more detail with reference to FIG. 3. The point of intersection of the two approximation straight lines AG1 and AG2 is determined and the current value which is assigned thereto is assigned to the saturation current I_sat_mes.

In a step S16, at least one of the profile parameters PP of the current profile SP is adapted, specifically with a view to ensuring that the injection valve 18 actually exhibits the desired injection behavior, that is to say in particular the current error of the current profile SP is compensated. In this case, a simple assignment rule can be determined in advance and stored. This assignment rule can in particular, include the fact that at least one of the profile parameters is adapted as a function of the saturation current I_sat_mes and the predefined reference saturation current. The predefined reference saturation current is preferably permanently stored in advance in the control device 25 and determined, for example, by measurements at a reference injection valve with a reference output stage unit. For example, for the purpose of adaptation a relative deviation between the saturation current I_sat_mes and the reference saturation current can be determined and this can be used as a factor for adapting the respective profile parameter PP. It is therefore possible to adapt an individual profile parameter and also even a plurality of the profile parameters PP in this step.

The program is subsequently ended in a step S18 and can, for example, then also be started cyclically again in the step S18. The program is preferably carried out separately for each output stage unit 25*a*, as a result of which injection-valve-specific adaptations of the profile parameters PP are brought about.

The at least one adapted profile parameter PP is then used subsequently for the further operation of the injection valve 18.

Figure 2:
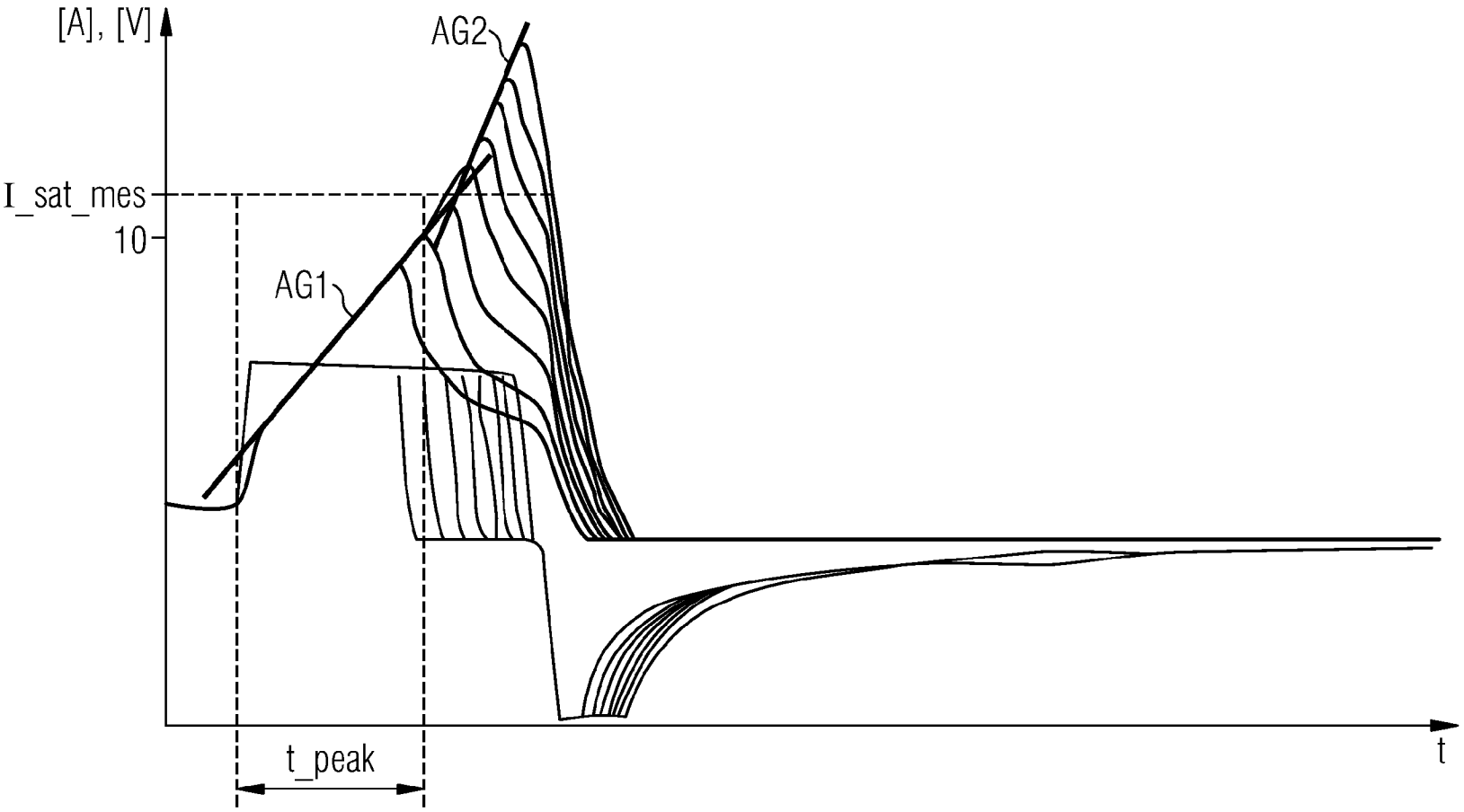
FIG. 2 shows a first signal illustration.

FIG. 2 illustrates current profiles of the current in the electromagnetic actuator which are sensed by way of example during the processing of the steps of the program according to FIG. 4, with, for example, the approximation straight lines AG1 and AG2 being shown.

The effect of the magnetic saturation and the associated increase in the gradient of the rise in current occur at approximately 11 A in this exemplary embodiment, and the saturation current I_sat_mes is therefore approximately 11 A in this exemplary embodiment.

Figure 3:
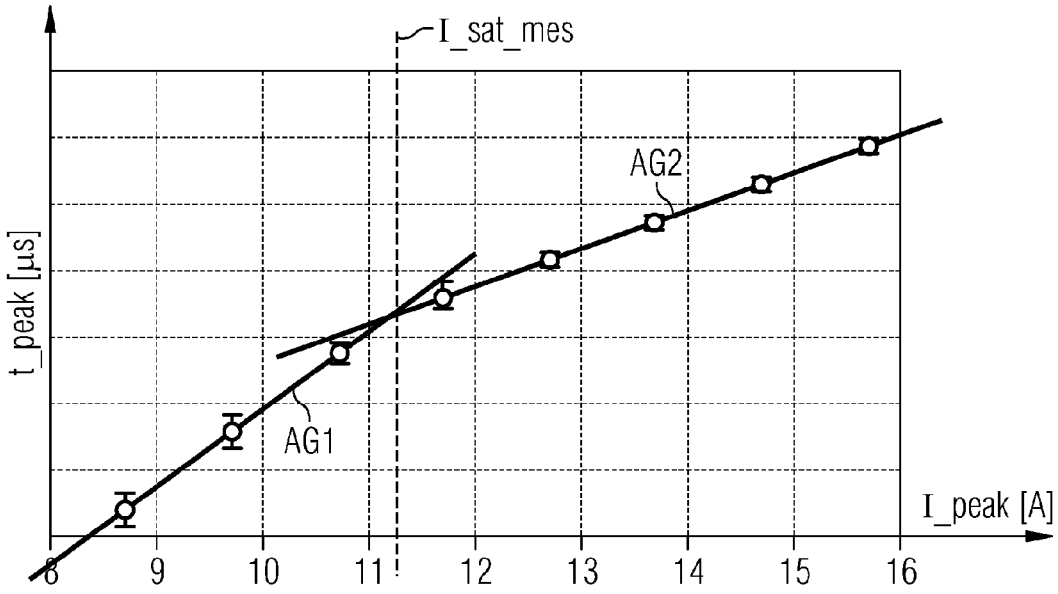
FIG. 3 shows a second signal illustration.

FIG. 3 illustrates the first and second approximation straight lines AG1 and AG2 by way of example.

Figure 5:
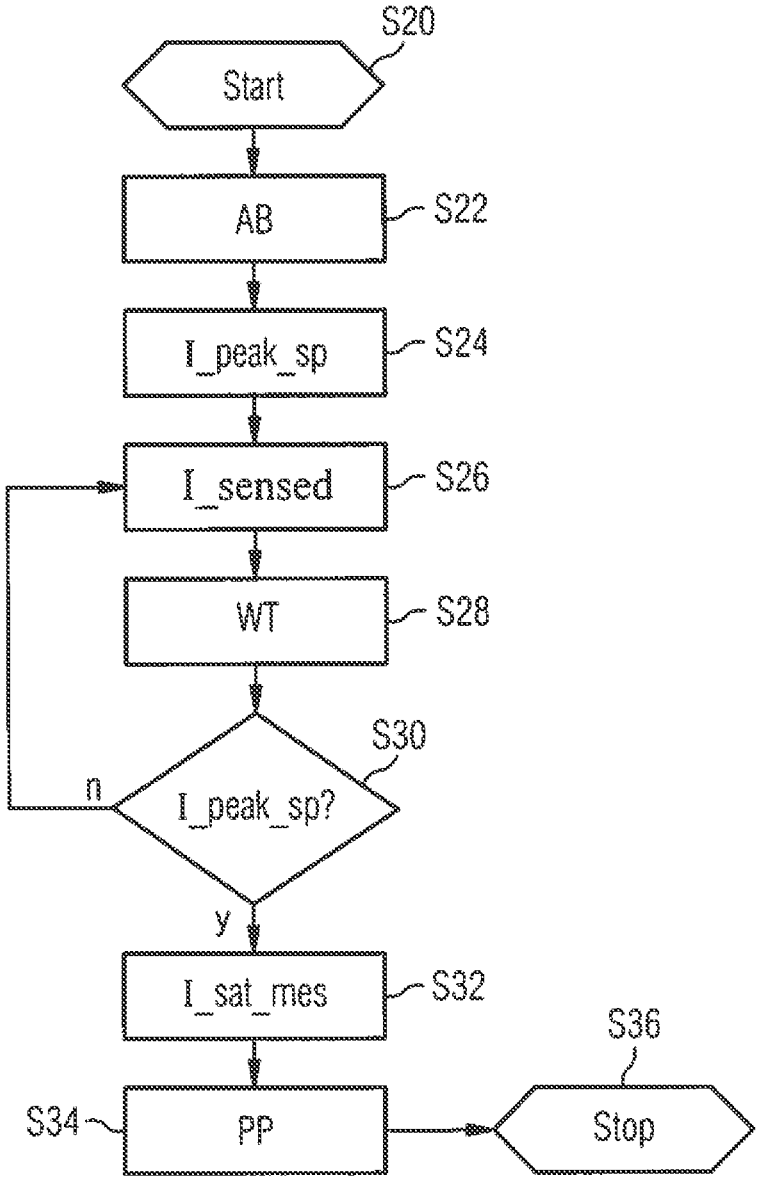
FIG. 5 shows a second flowchart.

A second flowchart of a further program is illustrated in FIG. 5. This program is, in particular, suitable for an output stage unit 25*a* whose setpoint peak value I_peak_sp of the current cannot be changed while the internal combustion engine is operating. The program can, however, basically also be used in an output stage whose setpoint peak value can be changed.

S20 and S22 correspond essentially to those of steps S1 and S2.

In a step S24, the setpoint peak value I_peak_sp of the current is predefined, said current being generally permanently predefined. In this context, said value is preferably predefined as the maximum value I_peak_sp_max, to be precise in such a way that the magnetic saturation of the electromagnetic actuator is reliably achieved. In particular, the predefined current profile SP and the model which is assigned thereto are used to determine the injection time period Ti, and the injection time period Ti is preferably determined in this context as a function of the quantity of fuel to be metered, the fuel pressure and the desired start of the metering of the fuel.

Starting from a predefined starting time within the rapid charge phase, at respectively predefined, spaced-apart times in a step S26 the actual current value which is then respectively current is sensed and, in a step S28, is stored in a memory together with the respectively assigned time period, which is related to the start of the rapid charge phase, as a respective value tuple WT in the step S28.

In a step S30 it is checked whether the actual setpoint value I_peak has reached the setpoint value I_peak_sp of the current and the predefined number of value tuples WT which is then predefined is therefore sensed and stored. If this is not the case, the processing is continued in the step S26 and a corresponding value tuple WT with a correspondingly assigned, increased actual current value is determined. The value tuples WT can therefore be determined during a single time period t_1 in this procedure. However, they can alternatively also be averaged by corresponding averaging of the corresponding respective value tuples of passes of the current profile SP for the respective injection valve 18, said passes occurring under essentially identical activation conditions AB, and in particular load conditions.

In a step S32, the saturation current I_sat_mes is then determined in accordance with the procedure of step S14 by means of the value tuples WT which are determined in the step S28. A step S34 then corresponds to the step S16 according to FIG. 4. A step S36 correspond to the step S18 according to FIG. 4.

What is claimed is:

1. A method for operating an internal combustion engine with at least one injection valve for metering fluid, which injection valve having an electromagnetic actuator, having an output stage unit which is designed to generate a current profile for actuating the electromagnetic actuator with at least one predefined profile parameter, the method comprising:

for each of a plurality of actuations, applying the current profile to the electromagnetic actuator to atuate the electromagnetic actuator, the current profile defining a plurality of profile parameters, analyzing a detected actual current during the plurality of actuations, calculating a saturation current based on the analyzed actual current during the plurality of actuations, the saturation current corresponding to a point at which a magnetic saturation of a magnetic circuit of the electromagnetic actuator is reached, and adapting the current profile by adapting at least one profile parameter of the current profile as a function of the determined saturation current and a predefined reference saturation current, and using the adapted current profile for at least one subsequent actuations of the electromagnetic actuator.

2. The method according to claim 1, wherein the current profile comprises a rapid rise phase during which a driver voltage which is increased compared to a supply voltage of the output stage unit is applied to the electromagnetic actuator, wherein during various actuations setpoint peak values of the current in the electromagnetic actuator are varied and respective time periods up to the point when the respective setpoint peak value is reached during the rapid rise phase are determined and the respective time periods which are determined in this way are stored with the respective setpoint peak values as value tupies, and the saturation current is determined as a function of the determined value tuples.

3. The method according to claim 2, wherein a first approximation straight line is determined as a function of those value tuples whose setpoint peak values are below a first predefined threshold value, and a second approximation straight line is determined as a function of those value tuples whose setpoint peak values are above a predefined second threshold value which is larger than the first threshold value, and wherein the saturation current is determined as a function of a point of intersection of the first approximation straight line with the second approximation straight line.

4. The method according to claim 3, wherein the approximation straight lines are determined by means of a regression method as a function of the least square error method.

5. The method according to claim 2, wherein the variation of the setpoint peak values of the current for determining the value tuples is carried out when predefined activation conditions apply.

6. The method according to claim 1 , wherein the current profile comprises a rapid rise phase during which a driver voltage which is increased compared to a supply voltage of the output stage unit is applied to the electromagnetic actuator, wherein during the rapid rise phase actual current values of the current are determined in the electromagnetic actuator at various predefined times and the respective actual current values which are determined in this way are stored with the assigned times as value tuples and the saturation current is determined as a function of the determined value tuples.

7. The method according to claim 6, wherein a first approximation straight line is determined as a function of those value tuples whose actual current value is below a first predefined threshold value, and a second approximation straight line is determined as a function of those value tuples whose actual current value is above a predefined second threshold value which is larger than the first threshold value, and wherein the saturation current is determined as a function of a point of intersection of the first approximation straight line with the second approximation straight line.

8. The method according to claim 7, wherein the approximation straight lines are determined by means of a regression method as a function of the least square error method.

9. The method according to claim 6, wherein the determination of the actual current values for determining the value tuples is carried out when predefined activation conditions apply.

10. The method according to claim 9, wherein the predefined activation conditions comprise a homogeneous operating mode of the internal combustion engine with a quasi-stoichiometric air/fuel ratio.

11. The method according to claim 9, wherein the predefined activation conditions comprise an idling mode or partial load operating mode of the internal combustion engine with quasi-steady-state operation.

12. The method according to claim 9, wherein the predefined activation conditions comprise the fact that at least one of a cooling water temperature, engine oil temperature, and output stage unit temperature are in respectively predefined temperature intervals.

13. The method according to claim 9, wherein the predefined activation conditions comprise the fact that a fluid pressure which is applied to the injection valve on the input side is set to a predefined low pressure value.

14. A device for operating an internal combustion engine comprising at least one injection valve for metering fluid, which injection valve comprises an electromagnetic actuator, having an output stage unit which is designed to generate a current profile for actuating the electromagnetic actuator with at least one predefined profile parameter, wherein the device is configured to:

for each of a plurality of actuations, apply the current profile to the electromagnetic actuator to atuate the electromagnetic actuator, the current profile defining a plurality of profile parameters, analyze a detected actual current during the plurality of actuations, calculate an assigned saturation current based on the analyzed actual current during the plurality of actuations, the saturation current corresponding to a point when a magnetic saturation of a magnetic circuit of the electromagnetic actuator is reached, and adapt the current profile by adapting at least one profile parameter of the current profile as a function of the determined saturation current and a predefined reference saturation current, and applying the adapted current profile to the electromagnetic actuator for at least one subsequent actuation of the electromagnetic actuator.

15. The device according to claim 14, wherein the current profile comprises a rapid rise phase during which a driver voltage which is increased compared to a supply voltage of the output stage unit is applied to the electromagnetic actuator, wherein during various actuations setpoint peak values of the current in the electromagnetic actuator are varied and respective time periods up to the point when the respective setpoint peak value is reached during the rapid rise phase are determined and the respective time periods which are determined in this way are stored with the respective setpoint peak values as value tuples, and the saturation current is determined as a function of the determined value tuples.

16. The device according to claim 15, wherein a first approximation straight line is determined as a function of those value tuples whose setpoint peak values are below a first predefined threshold value, and a second approximation straight line is determined as a function of those value tuples whose setpoint peak values are above a predefined second threshold value which is larger than the first threshold value, and wherein the saturation current is determined as a function of a point of intersection of the first approximation straight line with the second approximation straight line.

17. The device according to claim 16, wherein the approximation straight lines are determined by means of a regression method as a function of the least square error method.

18. The device according to claim 15, wherein the variation of the setpoint peak values of the current for determining the value tuples is carried out when predefined activation conditions apply.

19. The device according to claim 14, wherein the current profile comprises a rapid rise phase during which a driver voltage which is increased compared to a supply voltage of the output stage unit is applied to the electromagnetic actuator, wherein during the rapid rise phase actual current values of the current are determined in the electromagnetic actuator at various predefined times and the respective actual current values which are determined in this way are stored with the assigned times as value tuples and the saturation current is determined as a function of the determined value tuples.

20. The device according to claim 19, wherein a first approximation straight line is determined as a function of those value tuples whose actual current value is below a first predefined threshold value, and a second approximation straight line is determined as a function of those value tuples whose actual current value is above a predefined second threshold value which is larger than the first threshold value, and wherein the saturation current is determined as a function of a point of intersection of the first approximation straight line with the second approximation straight line.

* * * * *